US006241412B1

(12) United States Patent
Spies et al.

(10) Patent No.: US 6,241,412 B1
(45) Date of Patent: Jun. 5, 2001

(54) CARTRIDGE TOOTHBRUSH

(76) Inventors: Norbert Spies, 65812 Bad Soden, Oranienstrasse 69 (DE); L. Paul Lustig, 304 Greenwood St., Newton, MA (US) 02159; Andrew P. Tybinkowski, 39 Burning Bush Dr., Boxford, MA (US) 01921

( * ) Notice: Subject to any disclaimer, the term of this patent is extended or adjusted under 35 U.S.C. 154(b) by 0 days.

(21) Appl. No.: 09/314,786

(22) Filed: May 19, 1999

(51) Int. Cl.[7] ..... A46B 11/02

(52) U.S. Cl. ..... 401/129; 206/532; 222/83; 222/94; 222/105; 222/207; 222/209; 222/325; 401/134; 401/135; 401/140; 401/153; 401/183; 401/186

(58) Field of Search ..... 401/129, 132–135, 401/140, 146, 152, 153, 156, 157, 169, 183–186, 270, 271, 278, 279, 287, 205, 206; 222/83, 94, 105, 183, 191, 207, 209, 212, 325; 206/277, 532; 220/495.11, 495.08, 265, 278

(56) References Cited

U.S. PATENT DOCUMENTS

| | | | | |
|---|---|---|---|---|
| 1,676,601 | | 7/1928 | Cavanaugh . | |
| 1,859,402 | | 5/1932 | Maher . | |
| 2,081,792 | | 5/1937 | Cassanos et al. | 15/133 |
| 2,162,447 | | 6/1939 | Seibel | 221/60 |
| 2,259,928 | | 10/1941 | Eaton | 15/136 |
| 2,283,781 | * | 5/1942 | Aiken | 401/135 |
| 2,743,042 | | 4/1956 | Burgin | 222/191 |
| 2,795,245 | * | 6/1957 | Meehan | 222/209 X |
| 2,807,818 | | 10/1957 | Taylor | 15/136 |
| 2,845,645 | | 8/1958 | Wishnefsky et al. | 15/136 |
| 2,900,650 | | 8/1959 | Rivero | 15/138 |
| 2,960,040 | | 11/1960 | Bischoff | 103/148 |
| 3,148,684 | | 9/1964 | Keeler | 132/84 |
| 3,217,720 | | 11/1965 | Cyzer | 132/84 |
| 3,372,426 | | 3/1968 | Schwartzman | 401/183 |
| 3,400,996 | * | 9/1968 | Vandergrift | 401/184 |
| 3,417,762 | | 12/1968 | Hall | 132/84 |
| 3,864,047 | | 2/1975 | Sherrod | 401/278 |
| 3,910,706 | | 10/1975 | Del Bon | 401/134 |
| 3,936,200 | | 2/1976 | O'Rourke | 401/184 |
| 4,124,316 | * | 11/1978 | O'Rourke | 401/184 |
| 4,155,663 | | 5/1979 | Cerquozzi | 401/135 |
| 4,221,492 | | 9/1980 | Boscardin et al. | 401/184 |
| 4,236,651 | | 12/1980 | Meyer et al. | 222/82 |
| 4,580,588 | | 4/1986 | Swope, Jr. | 132/84 |
| 4,615,635 | | 10/1986 | Kim | 401/270 |
| 4,826,341 | | 5/1989 | Kwak | 401/280 |
| 4,850,730 | | 7/1989 | Jimenez et al. | 401/184 |
| 4,963,046 | * | 10/1990 | Eguchi | 401/146 X |
| 5,028,158 | | 7/1991 | Fey | 401/183 |
| 5,062,728 | | 11/1991 | Kuo | 401/176 |
| 5,338,124 | | 8/1994 | Spicer et al. | 401/280 |
| 5,346,324 | | 9/1994 | Kuo | 401/146 |
| 5,769,585 | * | 6/1998 | Podolsky | 222/207 X |
| 5,918,995 | * | 7/1999 | Puurunen | 401/186 X |

* cited by examiner

*Primary Examiner*—Lee Young
*Assistant Examiner*—Kathleen J. Prunner
(74) *Attorney, Agent, or Firm*—Pandiscio & Pandiscio

(57) ABSTRACT

An improved toothbrush is disclosed having a supply of liquid dentifrice located within the handle of the toothbrush, and a dispenser mechanism for dispensing the stored dentrifice to the bristles of the toothbrush when the need arises. The dentrifice-dispensing toothbrush is adapted to utilize replaceable, dentrifice-storing cartridges. In another preferred embodiment a dentrifice-dispensing toothbrush is provided which is effective in operation, durable, attractive in appearance, and relatively inexpensive to manufacture.

8 Claims, 15 Drawing Sheets

VALVE OPEN
335

SCALE 2:1
VALVE CLOSED
330

SCALE 2:1

VALVE CLOSED
335

SCALE 2:1
VALVE OPEN
330

SCALE 2:1

VALVE CLOSED
335

SCALE 2:1
345
335
325
320
340
320
330
VALVE CLOSED
330

SCALE 2:1

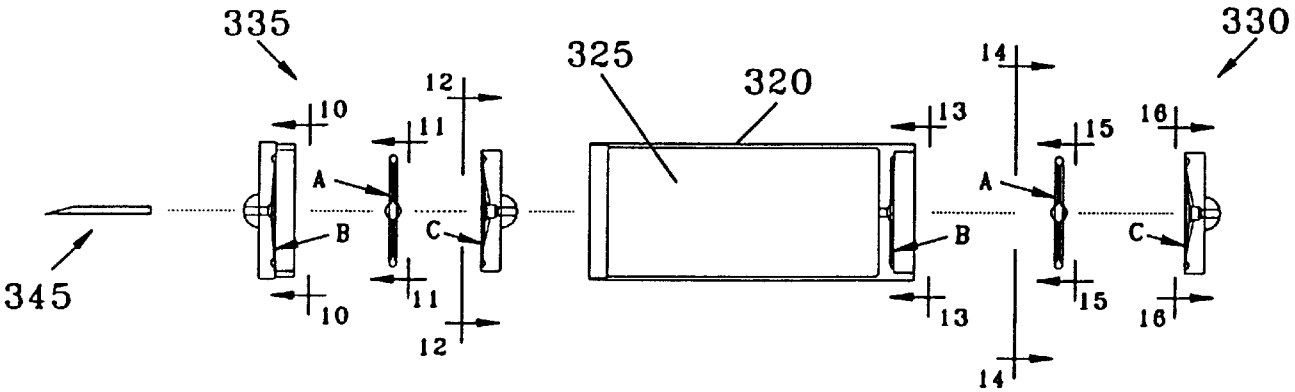
FIG. 9
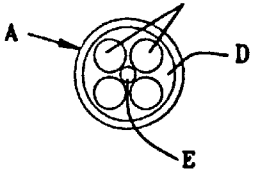
FIG. 10
FIG. 11
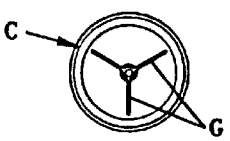
FIG. 12
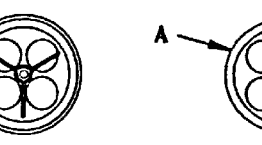
FIG. 13
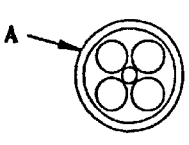
FIG. 14
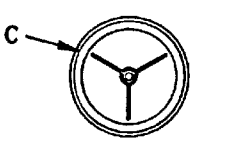
FIG. 15
FIG. 16

CARTRIDGE TOOTHBRUSH

FIELD OF THE INVENTION

This invention relates to dental apparatus in general, and more particularly to toothbrushes.

BACKGROUND OF THE INVENTION

Toothbrushes are well known in the art.

In general, a toothbrush comprises a head having a plurality of bristles extending therefrom, and a handle adapted to be grasped by the hand of the user.

In the typical situation, dentifrice is applied to the bristles of the toothbrush prior to the commencement of brushing. This is generally accomplished by grasping the handle of the toothbrush in one hand and the dentifrice container in the other hand, and then manually applying the dentifrice to the bristles of the toothbrush. Once the user has applied the dentifrice to the toothbrush, the user then commences brushing of the teeth.

Thus, with conventional toothbrushes, the dentifrice is generally held in a container separate from the toothbrush, and applying the dentifrice to the bristles of the toothbrush is a two-hand operation.

It has been recognized that it would be advantageous to provide an improved toothbrush having a supply of dentifrice located within the handle of the toothbrush, and a dispenser mechanism for dispensing the stored dentifrice to the bristles of the toothbrush for application to the teeth when the need arises.

In the past, there have been a number of proposals for achieving the foregoing, but all of these proposals are believed to suffer from one or more significant disadvantages, including ineffectiveness of operation, lack of durability, unattractiveness of appearance, prohibitive cost of manufacture, etc.

OBJECTS OF THE INVENTION

Accordingly, a primary object of the present invention is to provide an improved toothbrush having a supply of liquid dentifrice located within the handle of the toothbrush, and a dispenser mechanism for dispensing the stored dentifrice to the bristles of the toothbrush when the need arises.

Another object of the present invention is to provide a dentifrice-dispensing toothbrush adapted to utilize replaceable, dentifrice-storing cartridges.

And another object of the present invention is to provide a dentifrice-dispensing toothbrush which is effective in operation, durable, attractive in appearance, and relatively inexpensive to manufacture.

SUMMARY OF THE INVENTION

These and other objects of the present invention are addressed by the provision and use of a novel cartridge toothbrush.

In one form of the invention, the invention comprises a novel cartridge toothbrush, the cartridge toothbrush comprising a toothbrush and a cartridge; the toothbrush comprising a head and a handle; the head comprising a stem having a distal end and a proximal end; a plurality of bristles connected to the stem adjacent to the distal end of the stem; and a passageway extending through the stem, from the proximal end of the stem to the distal end of the stem adjacent to the bristles; and the handle comprising a pump and a cartridge-receiving recess; the pump comprising at least one flexible wall defining at least in part a chamber, an outlet port, an inlet needle, a first check valve disposed between the chamber and the outlet port so as to permit fluid to flow from the chamber to the outlet port but not from the outlet port to the chamber; and a second check valve disposed between the chamber and the inlet needle so as to permit fluid to flow from the inlet needle to the chamber but not from the chamber to the inlet needle; the pump being disposed so that the inlet needle protrudes into the cartridge-receiving recess; the proximal end of the head being connected to the distal end of the handle so that the outlet port of the handle is in communication with the passageway of the head; and the cartridge comprising a hollow housing having a distal end and a proximal end, the distal end of the housing being open and the proximal end of the housing including a passageway connecting the interior of the housing to the exterior of the housing; a bladder; and a cap; the proximal end of the bladder being disposed within the housing, and the distal end of the bladder being wrapped over the outside of the distal end of the housing; and the cap being secured in the distal end of the housing so as to fasten the distal end of the bladder to the housing; the cartridge being disposed within the cartridge-receiving recess of the handle such that the inlet needle extends through the cap and is in communication with the interior of the bladder.

In another form of the invention, the invention comprises a novel toothbrush comprising a head and a handle; the head comprising a stem having a distal end and a proximal end; a plurality of bristles connected to the stem adjacent to the distal end of the stem; and a passageway extending through the stem, from the proximal end of the stem to the distal end of the stem adjacent to the bristles; and the handle comprising a pump and a cartridge-receiving recess; the pump comprising at least one flexible wall defining at least in part a chamber, an outlet port, an inlet needle, a first check valve disposed between the chamber and the outlet port so as to permit fluid to flow from the chamber to the outlet port but not from the outlet port to the chamber; and a second check valve disposed between the chamber and the inlet needle so as to permit fluid to flow from the inlet needle to the chamber but not from the chamber to the inlet needle; the pump being disposed so that the inlet needle protrudes into the cartridge-receiving recess; the proximal end of the head being connected to the distal end of the handle so that the outlet port of the handle is in communication with the passageway of the head.

In still another form of the invention, the invention comprises a novel cartridge for use in a cartridge toothbrush, the cartridge comprising a hollow housing having a distal end and a proximal end, the distal end of the housing being open and the proximal end of the housing including a passageway connecting the interior of the housing to the exterior of the housing; a bladder; and a cap; the proximal end of the bladder being disposed within the housing, and the distal end of the bladder being wrapped over the outside of the distal end of the housing; and the cap being secured in the distal end of the housing so as to fasten the distal end of the bladder to the housing.

BRIEF DESCRIPTION OF THE DRAWINGS

These and other objects and features of the present invention will be more fully disclosed or rendered obvious by the following detailed description of the preferred embodiments of the invention, which is to be considered together with the accompanying drawings wherein like numbers refer to like parts, and further wherein:

FIG. 9 is a schematic exploded view of the pump shown in FIG. 6;

FIG. 10 is a schematic elevational view taken along line 10—10 of FIG. 9;

FIG. 11 is a schematic elevational view taken along line 11—11 of FIG. 9;

FIG. 12 is a schematic elevational view taken along line 12—12 of FIG. 9;

FIG. 13 is a schematic elevational view taken along line 13—13 of FIG. 9;

FIG. 14 is a schematic elevational view taken along line 14—14 of FIG. 9;

FIG. 15 is a schematic elevational view taken along line 15—15 of FIG. 9;

FIG. 16 is a schematic elevational view taken along line 16—16 of FIG. 9;

DETAILED DESCRIPTION OF THE PREFERRED EMBODIMENTS

Figure 1:
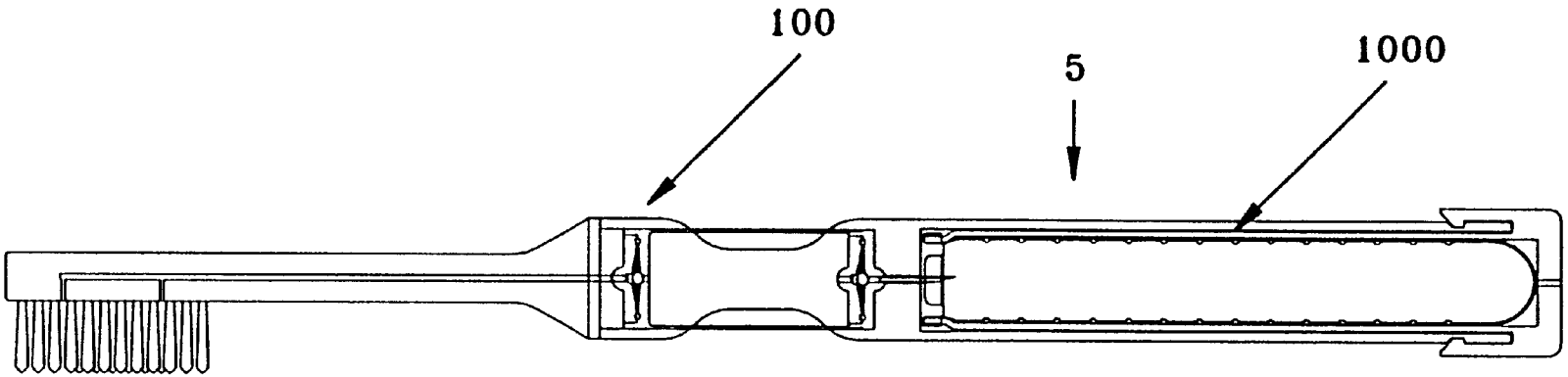
FIG. 1 is a schematic side view of a preferred form of cartridge toothbrush formed in accordance with the present invention.
Figure 2:
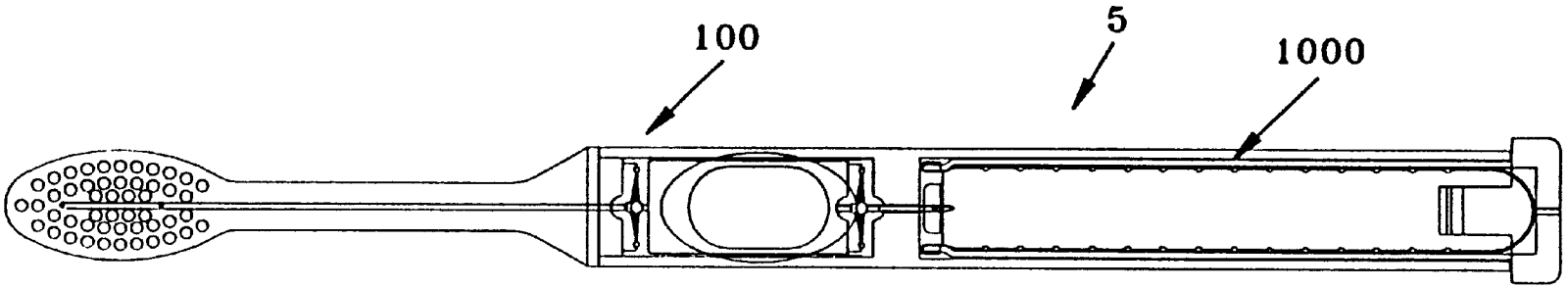
FIG. 2 is a schematic bottom view of the cartridge toothbrush shown in FIG. 1.

Looking first at FIGS. 1 and 2, there is shown a cartridge toothbrush 5 formed in accordance with the present invention.

Cartridge toothbrush 5 generally comprises a toothbrush 100 and a cartridge 1000, each of which will hereinafter be discussed in detail.

Figure 3:
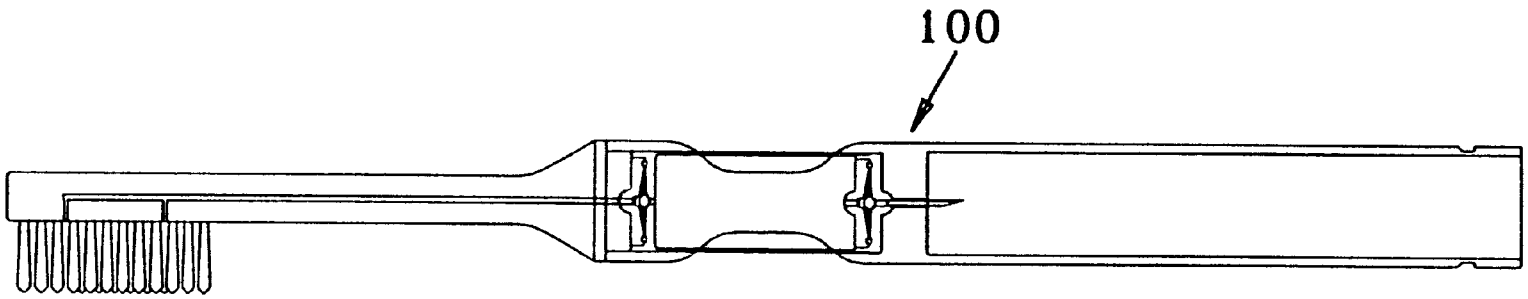
FIG. 3 is a schematic side view of the toothbrush portion of the complete cartridge toothbrush shown in FIG. 1.
Figure 4:
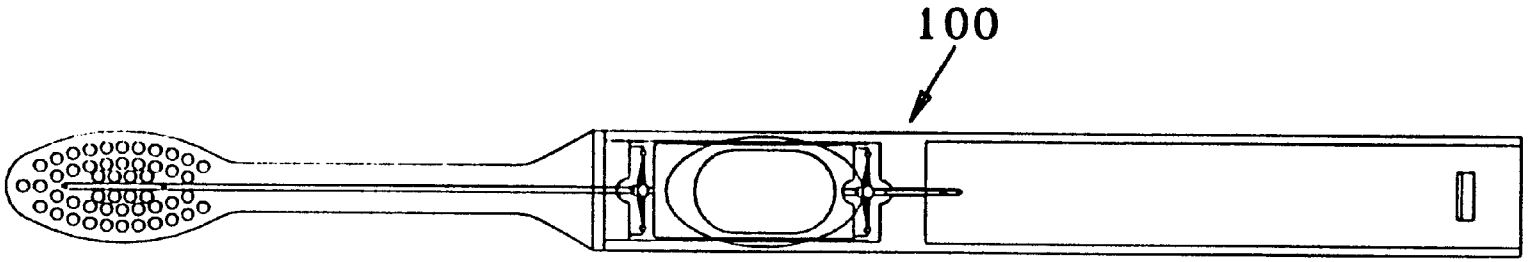
FIG. 4 is a schematic bottom view of the toothbrush shown in FIG. 3.
Figure 5:
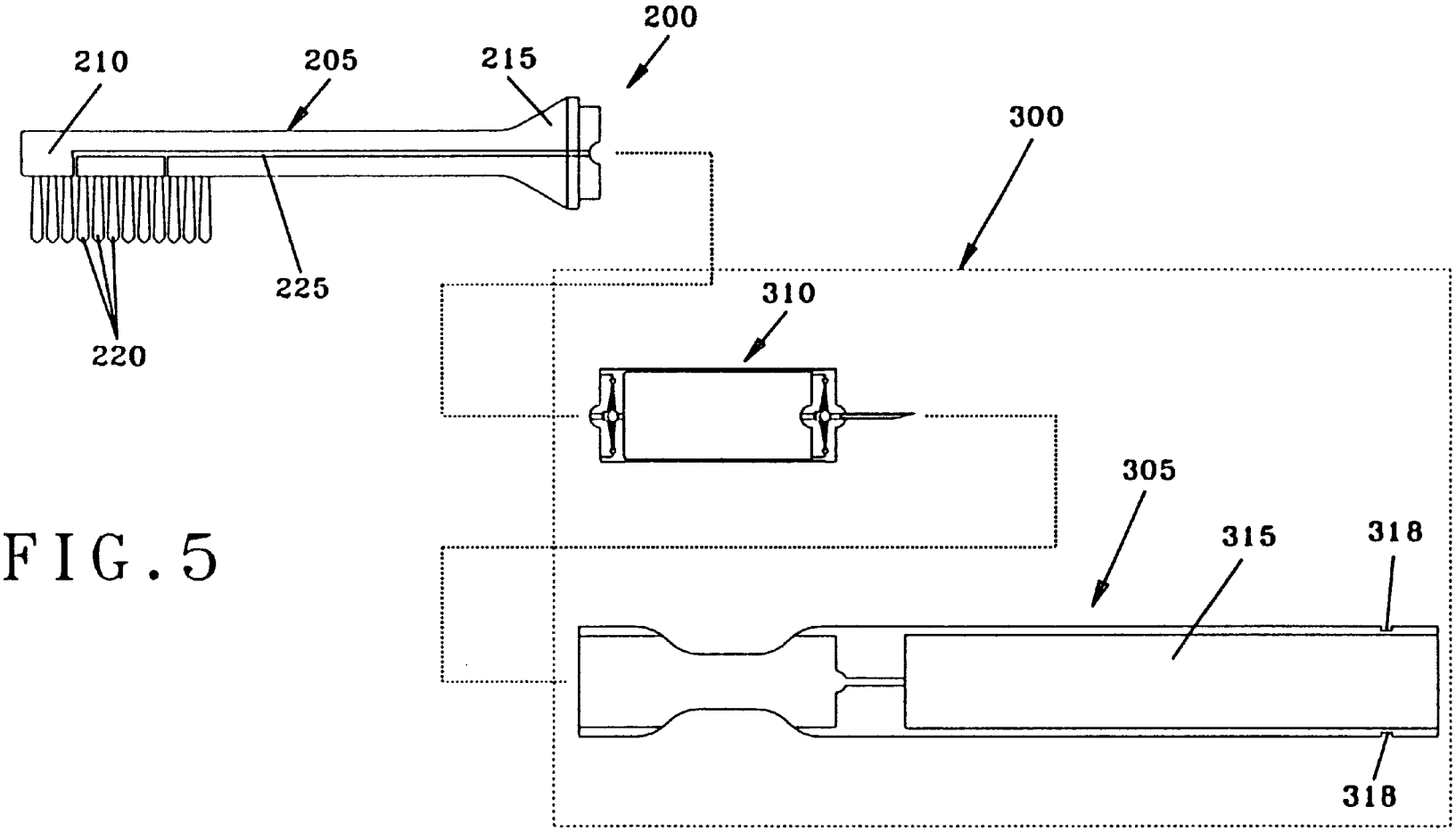
FIG. 5 is a schematic exploded view of the toothbrush shown in FIGS. 3 and 4.

More particularly, and looking now at FIGS. 3–5, toothbrush 100 generally comprises a head 200 and a handle 300.

Head 200 comprises a stem 205 having a distal end 210 and a proximal end 215. A plurality of bristles 220 extend outwardly from stem 205 generally adjacent to the distal end of the stem. A passageway 225 extends along stem 205. The distal end of passageway 225 opens adjacent to, and preferably amidst, bristles 220, and the proximal end of passageway 225 opens on the proximal end of stem 205. It will be appreciated that, on account of the foregoing construction, fluid introduced into passageway 225 at the proximal end of stem 205 may flow through that passageway so as to exit the passageway adjacent to, and preferably amidst, bristles 220.

Handle 300 comprises a housing 305 which generally includes a pump 310 and a cartridge-receiving recess 315. A pair of diametrically-opposed recesses 318 are formed on the outer surface of housing 305, adjacent to the proximal end of the housing. Recesses 318 are used to lock a cartridge 1000 to the toothbrush 100, as will hereinafter be discussed in greater detail.

Pump 310 comprises at least one flexible wall 320 partially defining a central chamber 325, a pair of check valves 330, 335, an outlet port 340, and an inlet needle 345.

Figures 6, 6A, 6B, 7, 7A, 7B, 8, 8A, 8B:
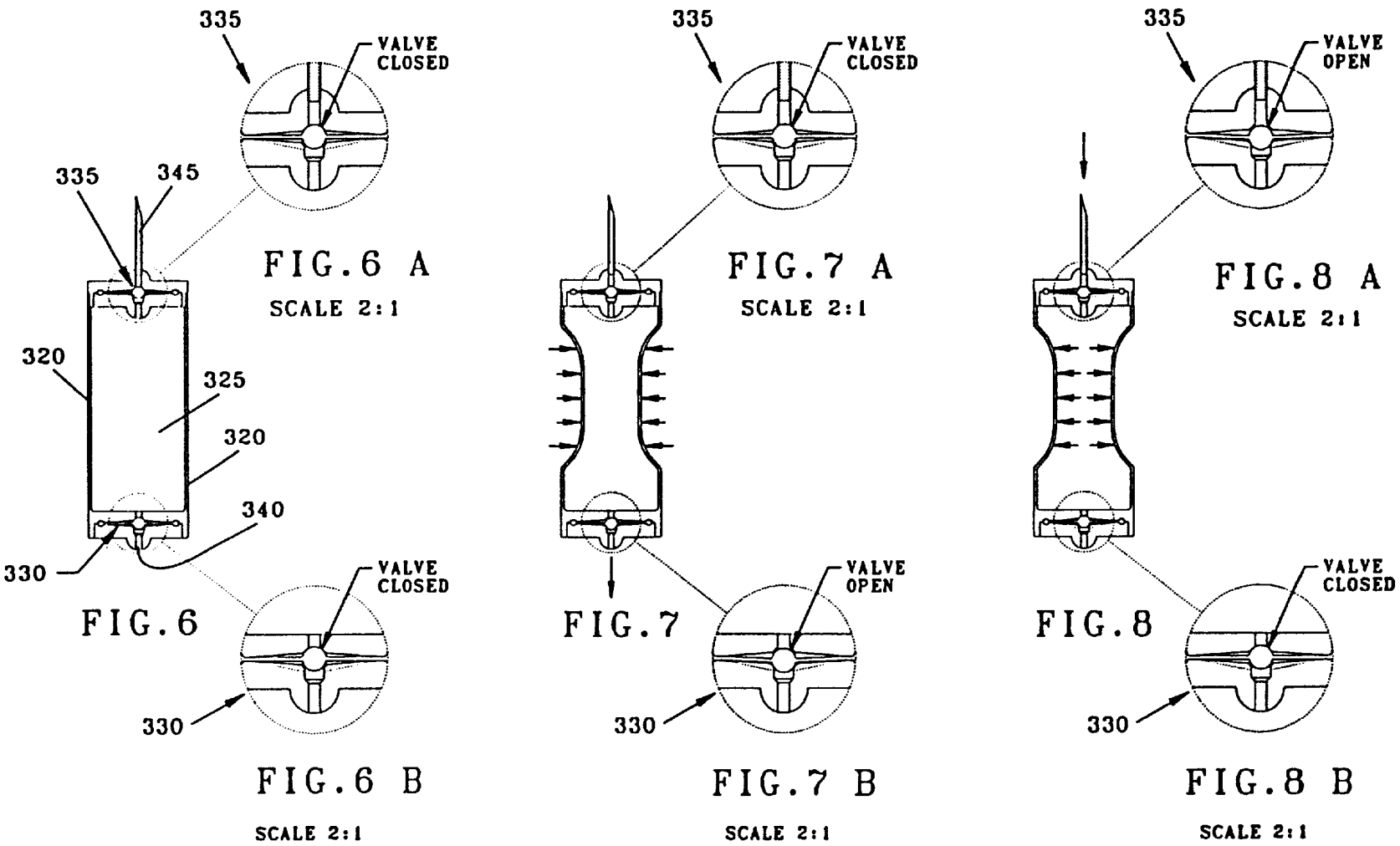
FIGS. 6, 6A, 6B, 7, 7A, 7B, 8, 8A and 8B are schematic views showing the toothbrush's dispenser mechanism, or pump, in various modes of operation.
Figure 6A:
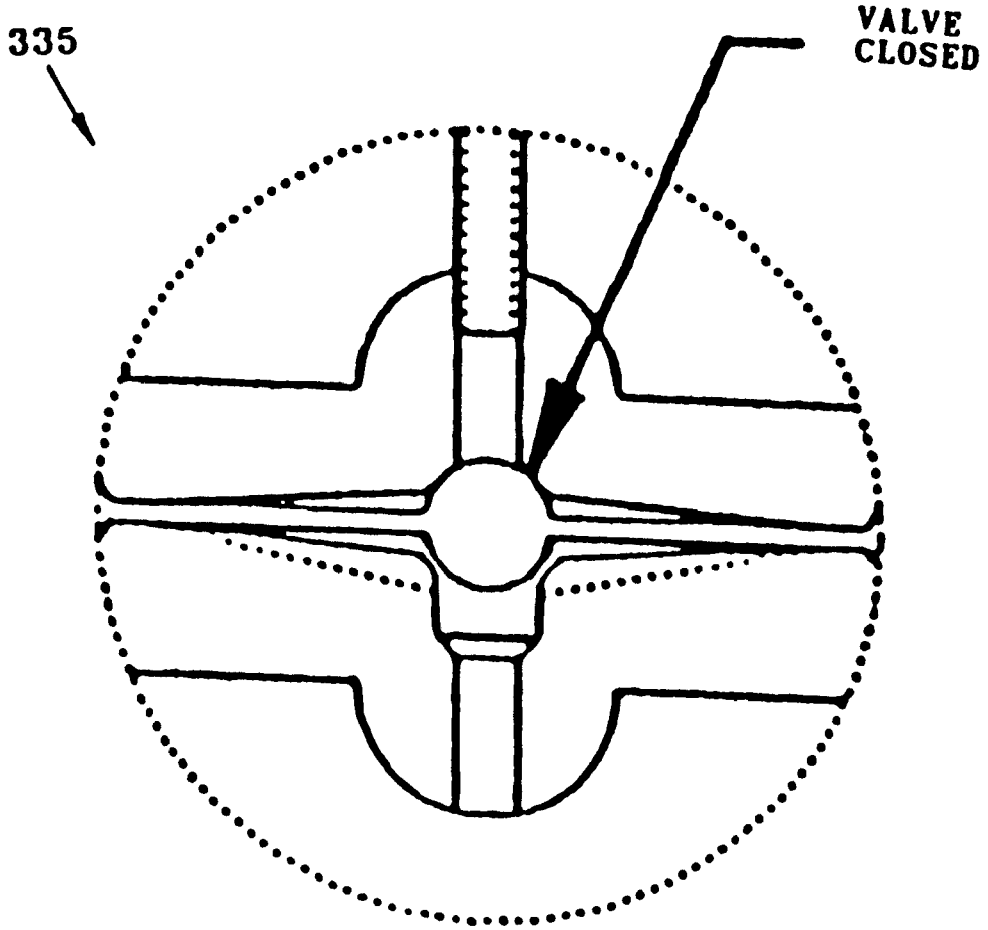
Figure 6B:
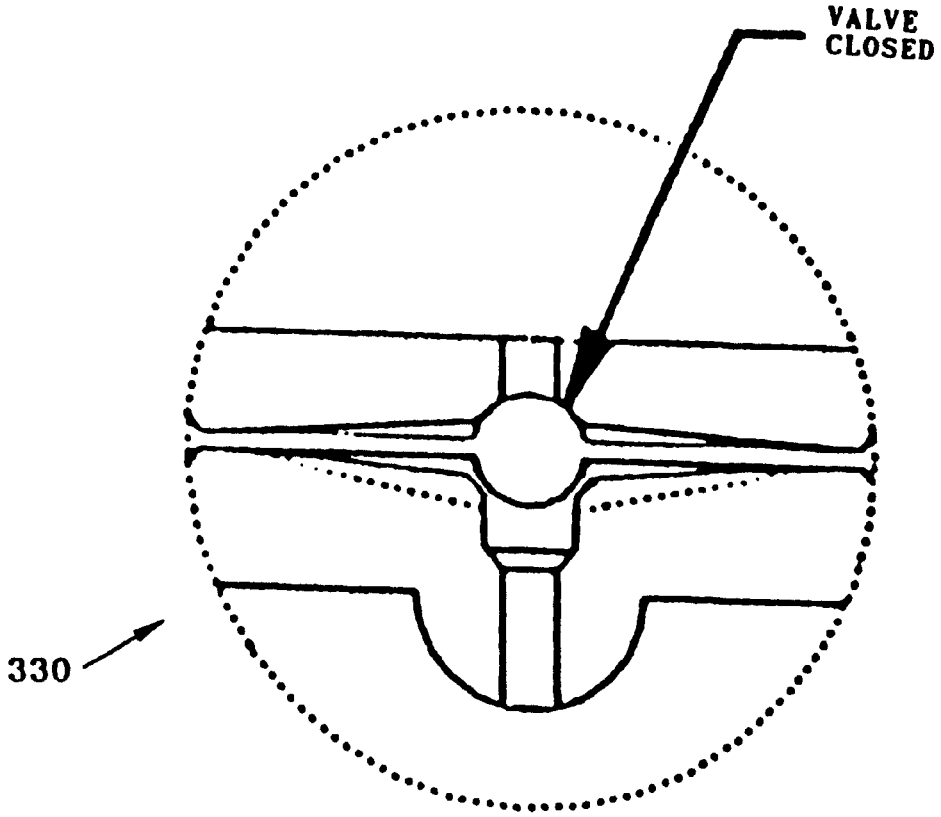
Figure 7A:
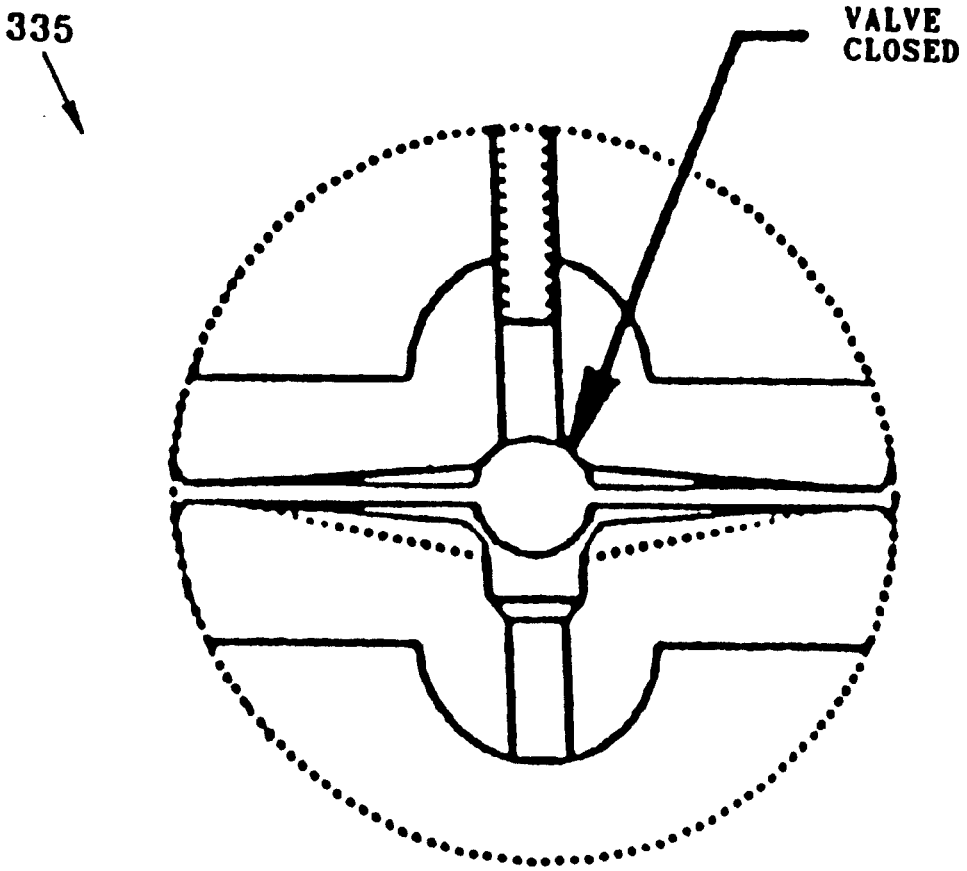
Figure 7B:
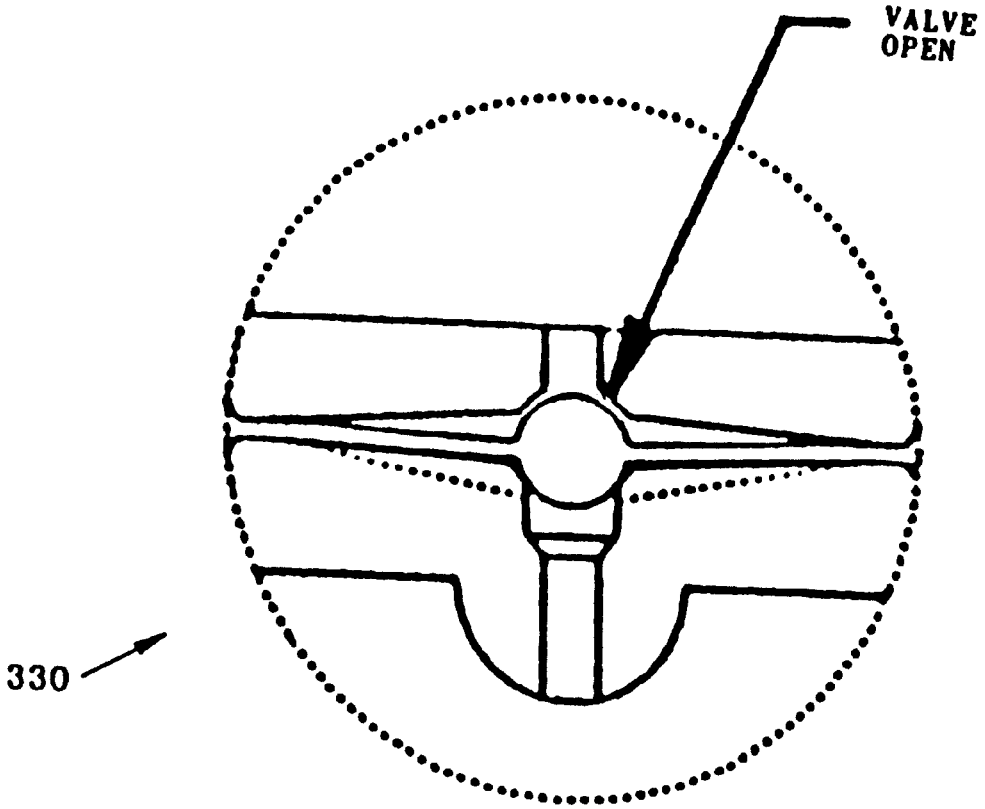
Figure 8A:
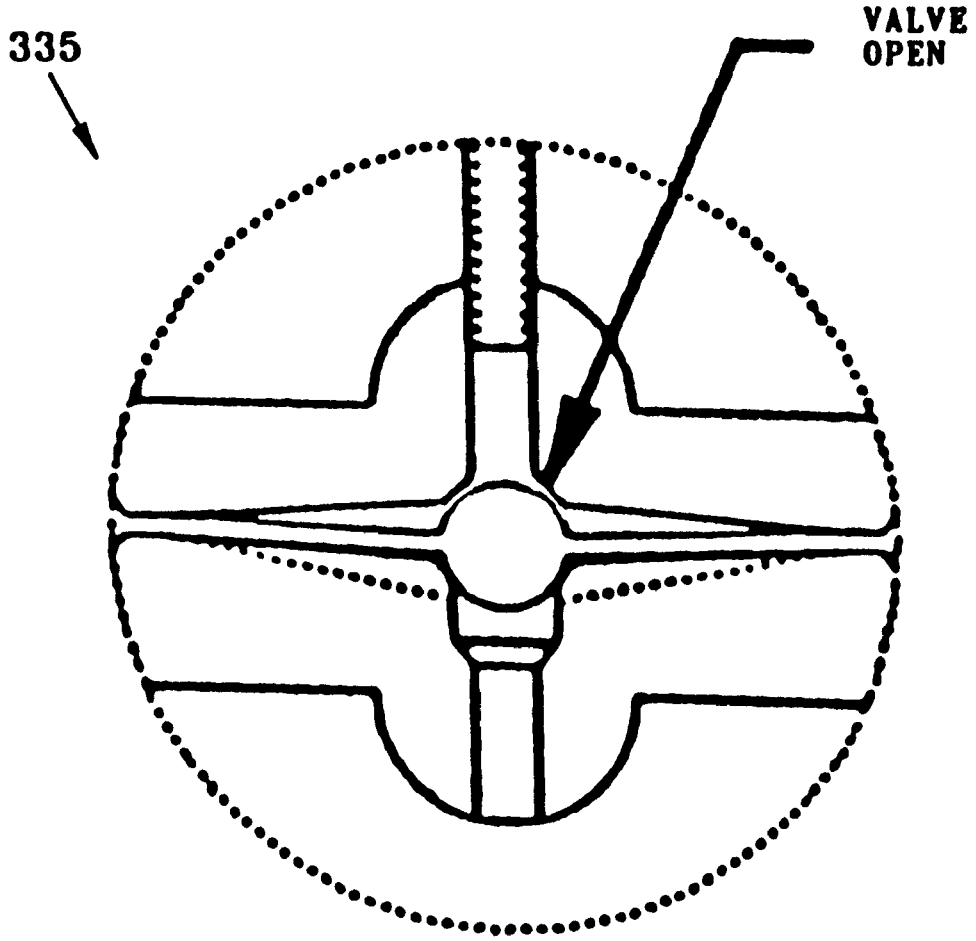
Figure 8B:
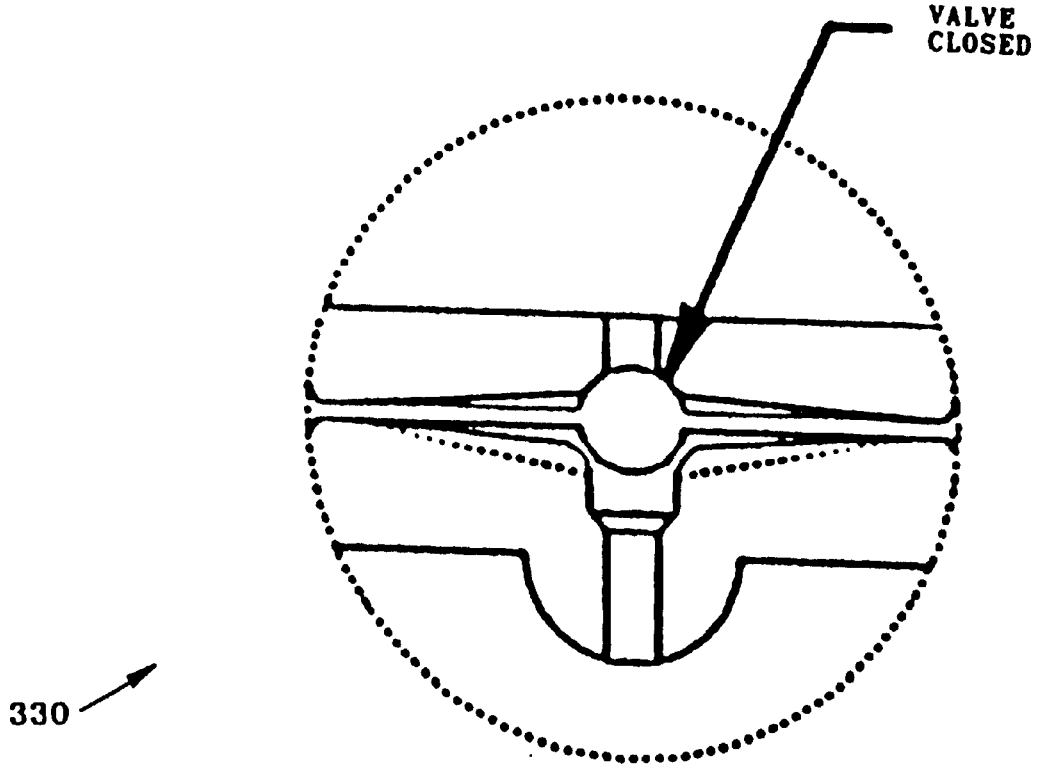
Figure 18:
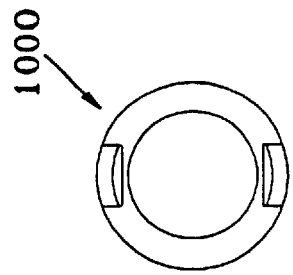
FIG. 18 is a schematic elevational view taken along line 18—18 of FIG. 17.

Pump 310 operates in the manner shown in FIGS. 1, 2, 6, 6A, 6B, 7, 7A, 7B, 8, 8A and 8B, that is:

(1) when needle 345 is in communication with an appropriate supply of fluid, and the at least one flexible wall 320 is initially pressed inwardly (FIG. 7), check valve 330 will permit air inside chamber 325 to be expelled out outlet port 340 (FIG. 7B) while check valve 335 will prevent air inside chamber 325 from being expelled out needle 345 (FIG. 7A);

(2) when the at least one flexible wall 320 is thereafter released (FIG. 8), check valve 335 will permit fluid from cartridge 1000 to be drawn into chamber 325 (FIG. 8A) through needle 345 while check valve 330 will prevent air or fluid from being drawn into chamber 325 from outlet port 340 (FIG. 8B);

(3) when the at least one flexible wall 320 is thereafter pressed inwardly again (FIG. 7), check valve 330 will permit fluid inside chamber 325 to be expelled out outlet port 340 (FIG. 7B) while check valve 335 will prevent air or fluid within chamber 325 from being expelled out needle 345 (FIG. 7A); and (4) when the at least one flexible wall 320 is thereafter released again (FIG. 8), check valve 335 will permit additional fluid from cartridge 1000 to be drawn into chamber 325 (FIG. 8A) through needle 345 while check valve 330 will prevent air or fluid from being drawn into chamber 325 from outlet port 340 (FIG. 8B).

Thus it will be seen that, by repeatedly depressing and releasing the pump's at least one flexible wall 320 in an in-and-out fashion, pump 310 will cause fluid to be drawn from cartridge 1000 into inlet needle 345 and to be expelled out outlet port 340, while preventing fluid from being drawn into outlet port 340 and expelled out inlet needle 345.

Pump 310 is positioned in housing 305 so that the pump's outlet port 340 is disposed at the distal end of housing 305, and so that the pump's needle 345 extends into the housing's cartridge-receiving recess 315. In this way, when the proximal end of the toothbrush's head 200 is connected to the distal end of the handle's housing 305, fluid leaving the pump's outlet port 340 can pass into passageway 225 of head 200. Additionally, when a cartridge 1000 is disposed in the housing's cartridge-receiving recess 315, needle 345 can access the fluid contained in cartridge 1000.

Preferably, the relative dimensions of the housing's cartridge-receiving recess 315 and needle 345 are coordinated with one another so that the sharp tip of needle 345 is safely shielded within recess 315. In addition, the dimensions of recess 315 and needle 345 are preferably formed so that fingers, both large and small, will be prohibited from contacting the sharp tip of needle 345. This construction constitutes an important safety feature of the present invention.

In one preferred embodiment of the present invention, such as that shown in FIG. 5, head 200, handle housing 305 and handle pump 310 are formed as three separate subassemblies which are subsequently joined together during manufacture so as to form the complete toothbrush 100. However, it should also be appreciated that the various components of toothbrush 100 may be assembled in some other manner if so desired.

Pump 310 may utilize any one of the many check valve constructions well known in the art. Preferably, however, pump 310 utilizes the specific check valves 330 and 335 shown in the drawings. More particularly, each check valve 330, 335 comprises a valve element A which reciprocates between a first seat B and a second seat C. Valve element A includes a web D carrying a ball E, wherein the web D is penetrated by four holes F. Second seat C includes three grooves G. As a result of this construction, when valve element A is in contact with first seat B, no fluid will be able to move past first seat B. However, when valve element A is in contact with second seat C, fluid can pass by second seat C by virtue of the passageways provided by the four holes F and three grooves G. Further details regarding the preferred construction of pump 310 will be apparent from FIGS. 6, 6A, 6B, 7, 7A, 7B, 8, 8A, 8B and 9–16, among others.

Cartridge 1000 is shown in detail in FIGS. 17–23. Cartridge 1000 generally comprises a housing 1100, a bladder 1200 and a cap 1300.

Housing 1100 comprises a hollow, elongated body 1105 having a distal end 1110 and a proximal end 1115. Distal end 1110 is open. Proximal end 1115 includes a passageway 1120 extending between the interior and exterior of body 1105, and a pair of fingers 1125. Passageway 1120 provides a path for air to pass into the interior of housing 1100, as will hereinafter be described in further detail.

Bladder 1200 comprises an elongated body 1205 having a distal end 1210 and a proximal end 1215. Distal end 1210 is open. Proximal end 1215 is closed. A plurality of circumferentially-extending ribs 1220 are preferably formed on the interior wall of body 1205. Alternatively, ribs 1220 can be formed on the exterior of body 1205 if desired. Ribs 1220 serve to help maintain body 1205 in the generally open (i.e., non-collapsed) shape shown in FIG. 22 prior to the filling of the bladder with dentifrice. In addition, ribs 1220 help keep the bladder's body open as dentifrice is withdrawn from the cartridge during use, so as to reduce the risk that some dentifrice may be trapped in the proximal portion of the bladder. In essence, ribs 1220 provide directional control to the collapse of bladder 1200 as dentifrice is withdrawn from the bladder, with bladder 1200 collapsing primarily longitudinally rather than primarily radially.

Figure 17:
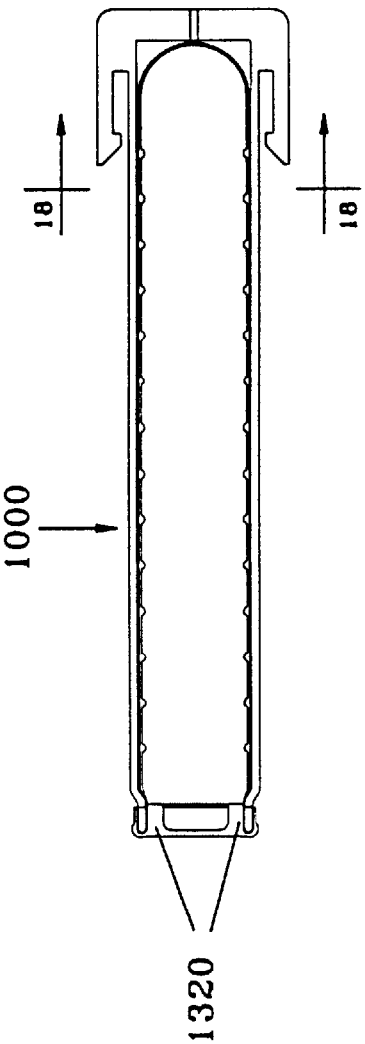
FIG. 17 is a schematic side view of the cartridge portion of the complete cartridge toothbrush shown in FIG. 1.
Figure 20:
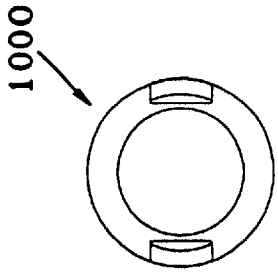
FIG. 20 is a schematic elevational view taken along line 20—20 of FIG. 19.
Figure 19:
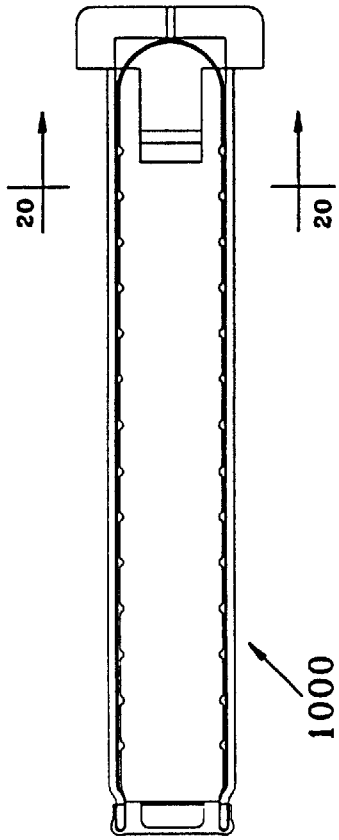
FIG. 19 is a schematic bottom view of the cartridge shown in FIG. 17.
Figure 23:
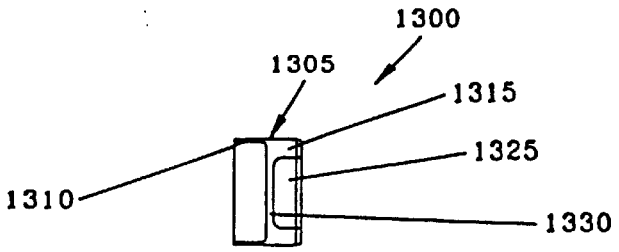
FIG. 23 is a schematic side view of the cartridge's cap (including seal) prior to the cap being fixed to the cartridge's housing.
Figure 22:
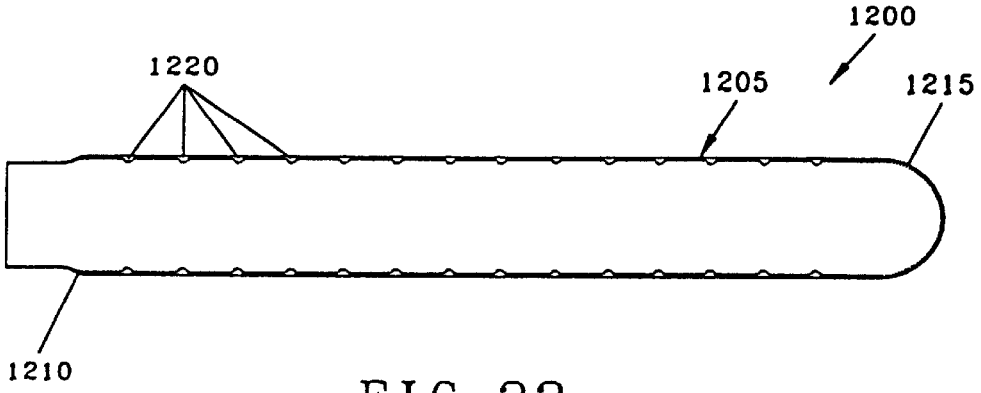
FIG. 22 is a schematic side view of the cartridge's bladder.
Figure 21:
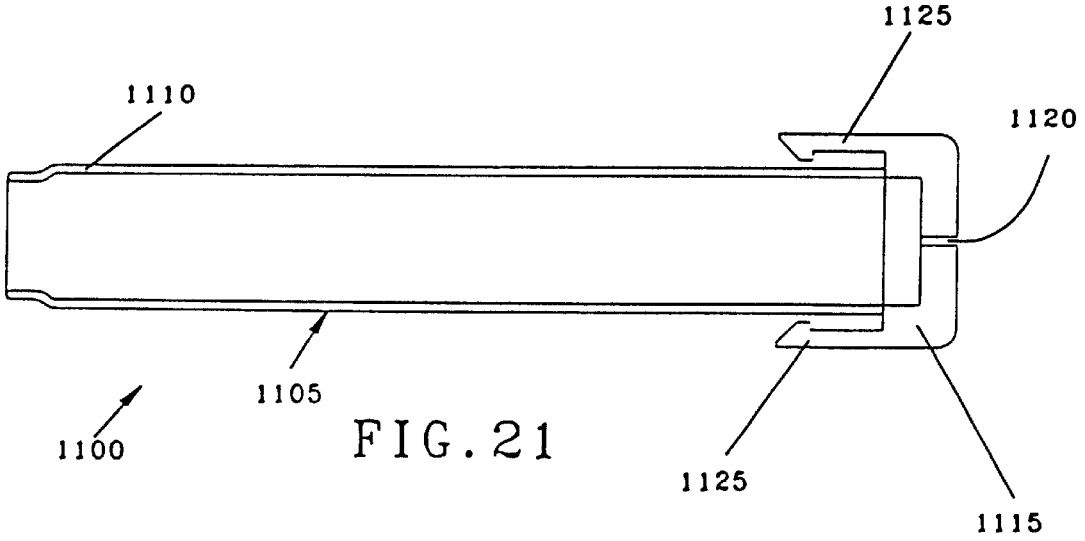
FIG. 21 is a schematic side view of the cartridge's housing.

Cap 1300 is shown in greater detail in FIGS. 17 and 23. Cap 1300 comprises a generally cylindrical body 1305 having a distal end 1310 and a proximal end 1315. Distal end 1310 is in the form of a plurality of fingers 1320 (FIG. 17). Proximal end 1315 includes a recess 1325. On account of the foregoing construction, it will be appreciated that cap 1300 comprises a relatively thin septum or seal 1330 separating the distal end of the cap from the proximal end of the cap.

Cartridge 1000 is intended to be assembled as follows. First, bladder 1200 is inserted into the interior of housing 1100. Then the distal end 1210 of bladder 1200 is pulled over the distal end 1110 of housing 1100. Then bladder 1200 is filled with dentifrice. Finally, cap 1300 is positioned in the mouth of housing 1100 and bladder 1200 so as to close off the interior of bladder 1200. Then cap fingers 1320 are folded over the exterior of the distal end of housing 1200 so as to secure cap 1300 (and hence its seal or septum 1330) in position and thereby complete the assembly of cartridge 1000.

It should be appreciated that when cap 1300 is in its position at the mouth of housing 1100, the cartridge's septum 1330 will be in a substantially fixed position relative to the remainder of cartridge 1000.

Cartridge toothbrush 5 is intended to be used as follows.

First, a fresh cartridge 1000 is selected and inserted into toothbrush 100. This is done by inserting cartridge 1000, distal end first, into the cartridge-receiving recess 315 in toothbrush 100. As cartridge 1000 is advanced within the cartridge-receiving recess 315, the cartridge's septum 1330 will engage the sharp proximal tip of the pump's needle 345 and, upon further distal movement of cartridge 1000, septum 1330 will be punctured by needle 345. Further distal movement of cartridge 1000 continues until the cartridge's fingers 1125 (FIG. 21) snap into the handle's recesses 318 (FIG. 5). At this point, cartridge 1000 will be securely attached (i.e., locked) to toothbrush 100, with the dentifrice in cartridge 1000 being in communication with pump 310.

Thereafter, in use, the user depresses and releases the pump's at least one flexible side wall 320 several times so as to advance dentifrice from the interior of bladder 1200, through pump 310, and out stem 205 amidst bristles 220, whereby the dentifrice contained in bladder 1200 will be applied to the teeth as the user brushes. It will be appreciated that the two check valve construction of pump 310 permits cartridge toothbrush 5 to be used regardless of orientation, i.e., cartridge toothbrush 5 will operate successfully when oriented horizontally, vertically, inverted, etc.

It will be appreciated that, as dentifrice is drawn out of bladder 1200, housing passageway 1120 (FIG. 21) will permit air to enter the interior of housing 1100, whereby bladder 1200 may easily release its dentifrice.

It will be appreciated that if, between brushing, cartridge toothbrush 5 should be laid down in a horizontal position while dentifrice is in cartridge 1000, no dentifrice will leak from the toothbrush due to the two check valve construction of pump 310.

When the dentifrice in cartridge 1000 has been completely used up, or when it is thereafter desired to use a different cartridge 1000, cartridge 1000 is released from toothbrush 100 by rotating cartridge 1000 (e.g., 90 degrees) from its locked position, whereupon the cartridge fingers 1125 (FIG. 21) will withdraw from handle recesses 318 (FIG. 5). With fingers 1125 released from recesses 318, cartridge 1000 is withdrawn proximally, away from toothbrush 100, whereupon a new cartridge 1000 may be inserted into the toothbrush handle.

Figure 25:
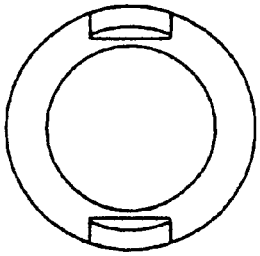
FIG. 25 is a schematic elevational view taken along line 25—25 of FIG. 24.
Figure 24:
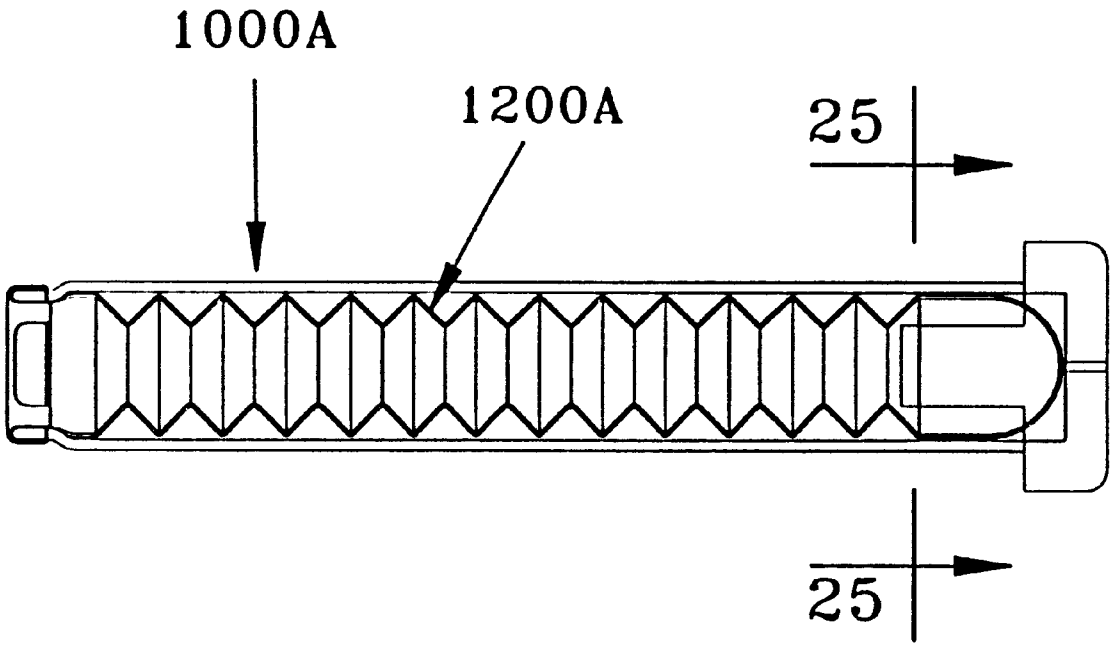
FIG. 24 is a schematic side view of an alternative form of cartridge.

An alternative cartridge 1000A is shown in FIGS. 24 and 25. Cartridge 1000A is substantially identical to the cartridge 1000 previously disclosed, except that it incorporates a bladder 1200A. Bladder 1200A utilizes a bellows-type construction to help hold bladder 1200A in an open (i.e., non-collapsed) configuration, whereby to facilitate handling and filling of the bladder. In addition, the bellows-type construction of bladder 1200A will help ensure that all of the dentifrice can be withdrawn from bladder 1200A as the bladder contracts, without the risk of some of the dentifrice becoming trapped in the proximal portion of the contracting bladder. In essence, the bellows-type construction of bladder 1200A provides directional control to the collapse of bladder 1200A as dentifrice is withdrawn from the bladder; bladder 1200A collapses primarily longitudinally rather than primarily radially.

Figure 27:
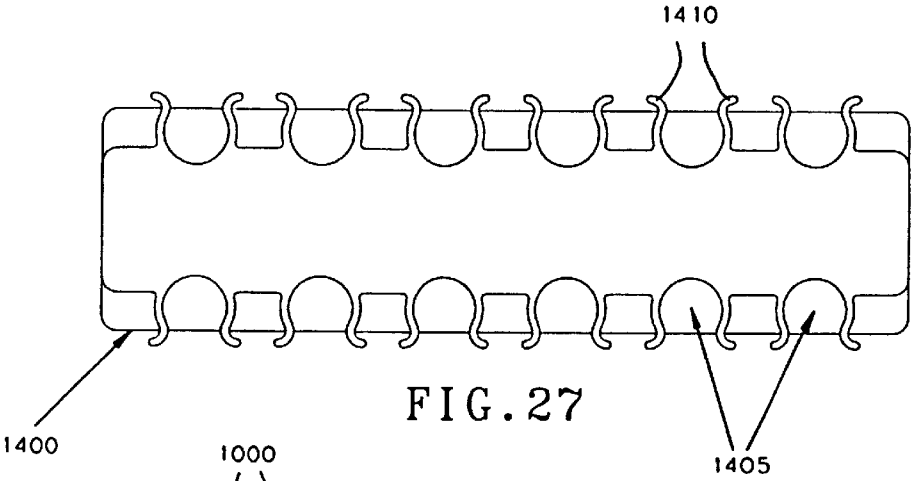
FIG. 27 is a schematic top view of the magazine shown in FIG. 26, with all of the cartridges having been removed from the magazine.
Figure 26:
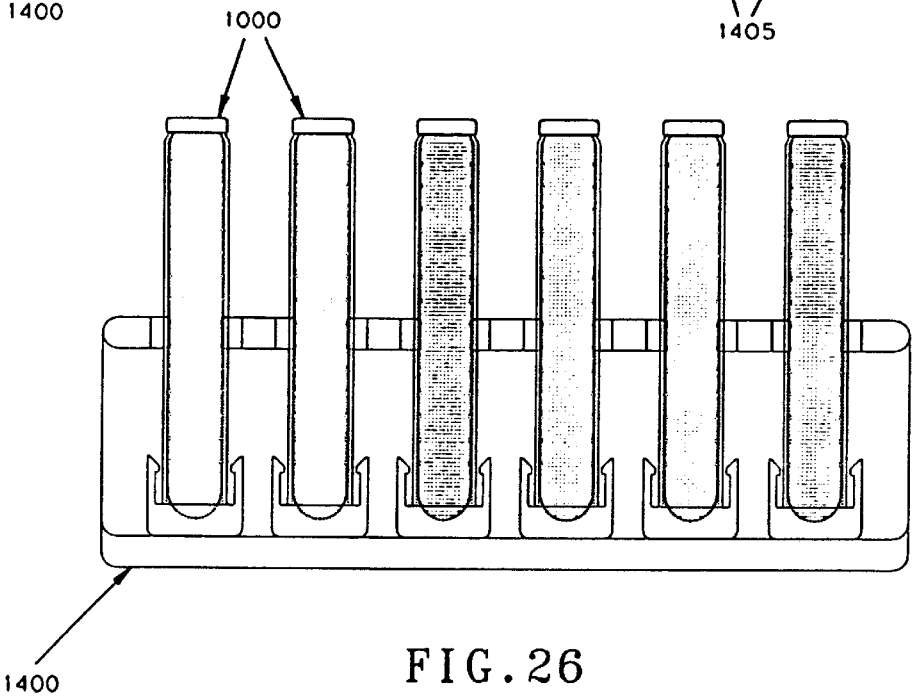
FIG. 26 is a schematic side view of a magazine holding a plurality of cartridges.

Looking next at FIGS. 26 and 27, there is shown a magazine 1400 for holding a plurality of cartridges 1000 and/or 1000A in an upright position. To this end, magazine 1400 comprises a plurality of cartridge-receiving stations 1405; fingers 1410 releasably hold a cartridge 1000 (1000A) in a station 1405.

It should also be appreciated that cartridge 1000 (and/or 1000A) might contain something other than, or something in addition to, dentifrice. For example, cartridge 1000 (1000A) might contain a pharmaceutical (e.g., an antibiotic or an anti-inflammatory, etc.) or a chemical (e.g., fluoride or a bleaching agent, etc.). In this respect it will be appreciated that, inasmuch as the cartridge's septum or seal 1330 can be made so as to effectively reseal itself after puncturing by needle 345, different cartridges 1000 (containing different operative liquids therein) can be snapped in and out of the toothbrush 100 during cartridge mid-use, without fear of spilling the contents of the cartridges.

Advantages Of The Invention

Numerous advantages are achieved through the provision and use of the present invention.

For one thing, the present invention provides an improved toothbrush having a supply of dentifrice located within the handle of the toothbrush, and a dispenser mechanism for dispensing the stored dentifrice to the bristles of the toothbrush when the need arises.

And the present invention provides a dentifrice-dispensing toothbrush adapted to utilize replaceable, dentifrice-storing cartridges.

Furthermore, the present invention provides a dentifrice-dispensing toothbrush which is effective in operation, durable, attractive in appearance, and relatively inexpensive to manufacture.

Still other advantages of the present invention will be obvious to a person skilled in the art.

What is claimed is:

1. A cartridge toothbrush, said cartridge toothbrush comprising a toothbrush and a cartridge:

said toothbrush comprising a head and a handle;

said head comprising a stem having a distal end and a proximal end; a plurality of bristles connected to said stem adjacent to said distal end of said stem; and a passageway extending through said stem, from said proximal end of said stem to said distal end of said stem adjacent to said bristles; and said handle comprising a pump and a cartridge-receiving recess, said handle having a distal end and a proximal end; said pump comprising at least one flexible wall defining at least in part a chamber, an outlet port, an inlet needle, a first check valve disposed between said chamber and said outlet port so as to permit fluid to flow from said chamber to said outlet port but not from said outlet port to said chamber; and a second check valve disposed between said chamber and said inlet needle so as to permit fluid to flow from said inlet needle to said chamber but not from said chamber to said inlet needle; said pump being disposed so that said inlet needle protrudes into said cartridge-receiving recess;

said proximal end of said head being connected to said distal end of said handle so that said outlet port of said handle is in communication with said passageway of said head; and said cartridge comprising a hollow housing having a distal end and a proximal end, said distal end of said housing being open and said proximal end of said housing including a passageway connecting the interior of said housing to the exterior of said housing; a bladder having a distal end and a proximal end; and a cap; said proximal end of said bladder being disposed within said housing, and said distal end of said bladder being wrapped over the outside of said distal end of said housing; and said cap being secured in said distal end of said housing so as to fasten said distal end of said bladder to said housing;

said cartridge being disposed within said cartridge-receiving recess of said handle such that said inlet needle extends through said cap and is in communication with the interior of said bladder.

2. A cartridge toothbrush according to claim 1 wherein said cartridge-receiving recess and said inlet needle are sized relative to one another such that the sharp tip of said inlet needle is shielded from direct contact by a person.

3. A cartridge toothbrush according to claim 1 wherein said bladder comprises a plurality of circumferentially-extending ribs.

4. A cartridge toothbrush according to claim 3 wherein said ribs are disposed on the interior of said bladder.

5. A cartridge toothbrush according to claim 1 wherein said bladder comprises a bellows construction.

6. A cartridge toothbrush according to claim 1 wherein said first check valve comprises a first seat, a second seat, and a valve element adapted to reciprocate between said first seat and said second seat, and further wherein said second seat comprises a plurality of grooves formed therein, and said valve element comprises a web carrying a ball, and further wherein said web is penetrated by a plurality of holes.

7. A cartridge toothbrush according to claim 6 wherein said second seat comprises three grooves formed therein, and said web has four holes therein.

8. A cartridge for use in a cartridge toothbrush, said cartridge comprising a hollow housing having a distal end and a proximal end, said distal end of said housing being open and said proximal end of said housing including a passageway connecting the interior of said housing to the exterior of said housing; a bladder having a distal end and a proximal end; and a cap; said proximal end of said bladder being disposed within said housing, and said distal end of said bladder being wrapped over the outside of said distal end of said housing; and said cap being secured in said distal end of said housing so as to fasten said distal end of said bladder to said housing.

* * * * *